US006340122B1

(12) United States Patent
Kamstrup-Larsen

(10) Patent No.: US 6,340,122 B1
(45) Date of Patent: Jan. 22, 2002

(54) SPREADER FOR SPREADING A FLUID, SUCH AS AN ADHESIVE

(75) Inventor: Jørgen Kamstrup-Larsen, Allerød (DK)

(73) Assignee: Casco A/S, Fredensborg (DK)

( * ) Notice: Subject to any disclaimer, the term of this patent is extended or adjusted under 35 U.S.C. 154(b) by 0 days.

(21) Appl. No.: 09/719,540

(22) PCT Filed: Jun. 18, 1999

(86) PCT No.: PCT/DK99/00335

§ 371 Date: Dec. 18, 2000

§ 102(e) Date: Dec. 18, 2000

(87) PCT Pub. No.: WO99/65612

PCT Pub. Date: Dec. 23, 1999

(30) Foreign Application Priority Data

Jun. 18, 1998 (DK) ..... 1998 00825

(51) Int. Cl.[7] ..... B05B 1/14

(52) U.S. Cl. ..... 239/548; 239/552; 239/553; 239/553.3; 239/553.5; 239/566; 239/591

(58) Field of Search ..... 239/548, 550, 239/552, 553, 553.3, 553.5, 562, 566, 590, 590.3, 590.5, 591, 592, 600

(56) References Cited

U.S. PATENT DOCUMENTS

| | | | | | |
|---|---|---|---|---|---|
| 748,862 | A | * | 1/1904 | Hammel | 239/591 X |
| 3,020,579 | A | * | 2/1962 | O'Connor | 239/552 X |
| 3,895,984 | A | | 7/1975 | Cone et al. | 156/79 |
| 4,419,141 | A | | 12/1983 | Kunkel | 134/22 |
| 4,962,891 | A | * | 10/1990 | Layden | 239/590 X |
| 5,503,336 | A | * | 4/1996 | Wichmann | 239/590.5 X |

* cited by examiner

*Primary Examiner*—Robin O. Evans
(74) *Attorney, Agent, or Firm*—Jacobson Holman, PLLC

(57) ABSTRACT

A spreader for spreading a fluid, such as an adhesive, in a thin layer on a surface including a spreader housing and a plurality of outlet nozzles, which are arranged at regular intervals along one side of the spreader housing, and which are connected to a feeding channel system accommodated in the housing. The feeding channel system communicates with an inlet opening for the fluid. The nozzles, the feeding channel system thereof and the inlet opening are shaped in a separate lining detachably secured in the housing, the housing including cavities for receiving the lining and being able to firmly clamp around the lining in use, and whereby at least one opening is provided in the housing, where the nozzles project from the interior of the housing through the opening.

12 Claims, 5 Drawing Sheets

SPREADER FOR SPREADING A FLUID, SUCH AS AN ADHESIVE

TECHNICAL FIELD

The invention relates to a spreader for spreading a fluid, such as an adhesive, in a thin layer on a surface, said spreader comprising an oblong spreader housing and a plurality of outlet nozzles which are arranged at regular intervals along one side of the spreader housing, and which are connected to a feeding channel system accommodated in the housing and in turn connected to an inlet opening for said fluid.

BACKGROUND ART

It is known to apply adhesive onto a large surface through a number of nozzles in a spray spreader. The adhesive in question is pumped from a suitable source to a coupling device through a conduit, said conduit or conduits (used in connection with a two-component adhesive) being connected to the spreader. The known spreader comprises often a pipe or bar-like member of a length rendering it possible to coat the surface in question with the adhesive layer in question by way of a single relative movement of said surface past the spreader. Therefore, the nozzles in question are arranged adjacent one another at regular intervals. Such spreaders are for instance used in connection with plants, where the plates to be coated with an adhesive layer are advanced stepwise on a conveyor belt, said plates being advanced in lengths corresponding to the length of a spreader, such as 0.5 m, in each step. Subsequently, the spreader is moved transverse to the advancing path of the conveyor belt at the same time as adhesive is fed through the nozzles of the spreader. After each transverse movement of the spreader, the plate placed on the conveyor belt is advanced yet another step. Such plants can for instance process plates of up to 3 times 6 m to be used for the production of sandwich elements. The adhesive types in question are typically high-viscous fluids requiring a high pressure, such as 20 to 180 bar, in order to be pressed through feeding conduits and nozzles. A spreader for applying adhesive onto such plates comprises a very high number of nozzles, and accordingly it is very difficult to keep such nozzles clean or to clean said nozzles after the use thereof. Often it is not possible to carry out such a cleaning process without the use of suitable solvents. Accordingly, the cleaning process is both cost-intensive and time-consuming.

BRIEF DESCRIPTION OF THE INVENTION

The object of the present invention is to provide a spreader avoiding the necessity of a cost-intensive and time-consuming cleaning process as well as the use of separate solvents.

The above is obtained by the spreader according to the invention being characterised in that the nozzles, their feeding channel system, and the inlet opening being shaped in a separate lining detachably secured in the housing, whereby the housing comprises cavities receiving the lining and being adapted to fixedly clamp around said lining during the use of the spreader, at least one opening being provided in said housing, where the nozzles project from the interior of the housing through said opening.

When this spreader is used, nothing but the lining is replaced by a new lining when required by the nozzles or the associated feeding channel system.

The lining may particularly advantageously comprise two interconnected, substantially plate-shaped lining members with recesses provided therein to form the nozzles the feeding channel system of said nozzles as well as the inlet opening. Such plate-shaped lining members are easy to manufacture of a suitable disposable material, such as board or plastics.

The housing may according to the invention comprise two hingedly interconnected housing parts provided with means for tightening said housing parts around the lining with the result that the opening and the closing of said housing is particularly simple.

Moreover, the lining members may according to the invention be plate or sheet-extruded, vacuum-moulded plates of plastics, which are glued or welded to one another, whereby the outlet nozzles shaped in one lining member comprise outlet orifices or openings resulting from a cutting off of portions of said lining member. The resulting manufacture of the lining members is particularly easy and inexpensive.

Furthermore, the nozzles may according to the invention be shaped in a number of rows protruding from a plane of a first plate-shaped lining member in such a manner that each nozzle extends from a plane portion coinciding with the side facing the second lining member, and the feeding channel system may form a nozzle feeding chamber adjacent said nozzles, where said nozzle feeding chamber is formed by a coherent recess in the second lining member opposite said nozzles. As a result, a particularly simple feeding of the nozzles is obtained.

According to the invention the nozzle feeding chamber may particularly advantageously be formed by a small, trough-shaped recess in the second lining member, where said small trough-shaped recess extends along the row or rows of nozzles and comprises longitudinal sides, of which one longitudinal side is positioned opposite the area along one side of the row or rows of nozzles and the other longitudinal side is positioned opposite the area along the opposite side of the row or rows of nozzles, but at a predetermined distance therefrom, said latter area being positioned upstream relative to the flow direction of the fluid inside the feeding channel system, and where a comparatively larger recess is provided opposite the small trough-shaped recess at the upstream side and along the row or rows of nozzles in the first lining member comprising said nozzles, whereby a distribution chamber is formed in this portion of the feeding channel system, said distribution chamber communicating directly with the nozzle feeding chamber. The spreader is particularly suited for use in connection with an application process involving returning interruptions between the individual applications of adhesive while producing a multilayer sandwich element or when said element is to be replaced. These interruptions can last from 1 minute and up to several hours. The structure in question of the nozzles with the associated feeding chamber and distribution chamber ensures that the interruption does not involve a noticeable afterflow of the adhesive in question, which is due to the fact that the adhesive present at a level above the nozzles is not significant and that said adhesive is instead present in the distribution chamber at a level below the inlet of each nozzle. The possible interruption period in question depends, of course, on the type of adhesive in question because said type of adhesive must not, of course, be able to cure inside the interior of the nozzles during said interruption period.

According to the invention, the portion of the feeding channel system adjacent the distribution chamber may be formed substantially by one or more recesses in the first lining member housing the nozzles, whereby the afterflow of adhesive material in connection with an interruption of the application process is not additionally stimulated.

The feeding channel system may according to the invention be provided with one or more static mixers, whereby the components of the adhesive material are efficiently mixed during the flow towards the nozzles. This or these static mixer(s) may according to the invention be arranged in their respective separate tubes, whereby it is ensured that the adhesive material does not flow round said static mixers because the separate tubes associated with said mixers can be formed very accurately to fit said static mixers.

A static mixer with the associated separate tube may according to the invention be arranged in connection with the inlet opening and comprise projecting members with means for coupling the spreader to a mixer head, which in turn comprises means for connecting conduits thereto, said conduits communicating with sources with their respective components of a two-component adhesive system. As a result, a particularly simple connection is obtained between the lining and the conduit system advancing the adhesive to the spreader.

The second lining member may according to the invention be made of a resilient plastic material, and the spreader may comprise means for allowing a closing of each nozzle by pressing the second lining member towards the first lining member opposite each nozzle.

BRIEF DESCRIPTION OF THE DRAWINGS

The invention is explained in greater detail below with reference to the accompanying drawings, in which.

BEST MODE FOR CARRYING OUT THE INVENTION

Figure 1:
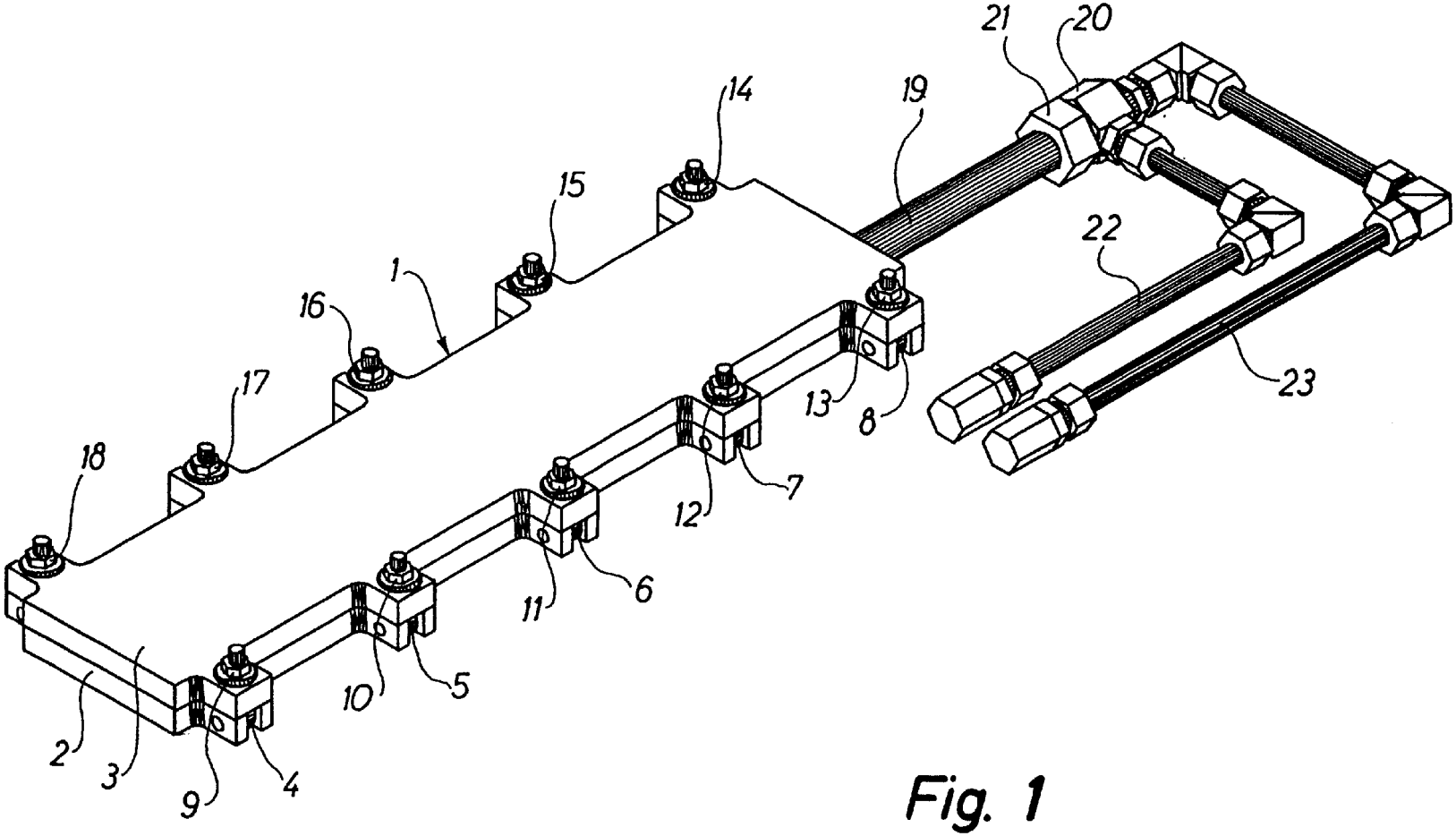
FIG. 1 is a perspective view of a spreader according to the invention and connected to a mixer head and conduits associated therewith for the feeding of the individual components of a two-component adhesive system.

The spreader illustrated in FIG. 1 is designated the general reference numeral 1 and comprises two substantially plate-shaped housing parts 2 and 3 hingedly interconnected by means of hinges 4 to 8. These housing parts can be firmly fixed to one another by means of clamping means 9 to 18. When firmly fixed to one another, these housing parts 2, 3 form a housing, through which a fluid, such as an adhesive, can be applied onto a plate being carried past the spreader 1 at a level therebelow while said spreader 1 is maintained in a state in which the bottom side of the lower housing part 2 is arranged at a substantially horizontal plane.

A conduit 19 connects the spreader 1 with a mixer head 20 by means of a coupling nut 21. The mixer head 20 is connected to two conduits 22 and 23 for the feeding of their respective components of a two-component adhesive system. The two components of the adhesive system are fed to the conduits 22 and 23 by means of suitable pumps from their respective sources and mixed in the mixer head 20. The two components of the adhesive system leave the mixer head 20 in a mixed state and flow through the conduit 19 into the spreader 1.

Figure 2:
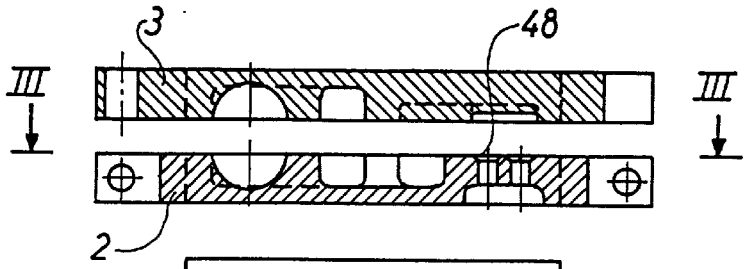
FIG. 2 is a cross sectional, slightly staggered view taken along the line II—II of FIG. 3 of the housing of the spreader of FIG. 1.
Figure 3:
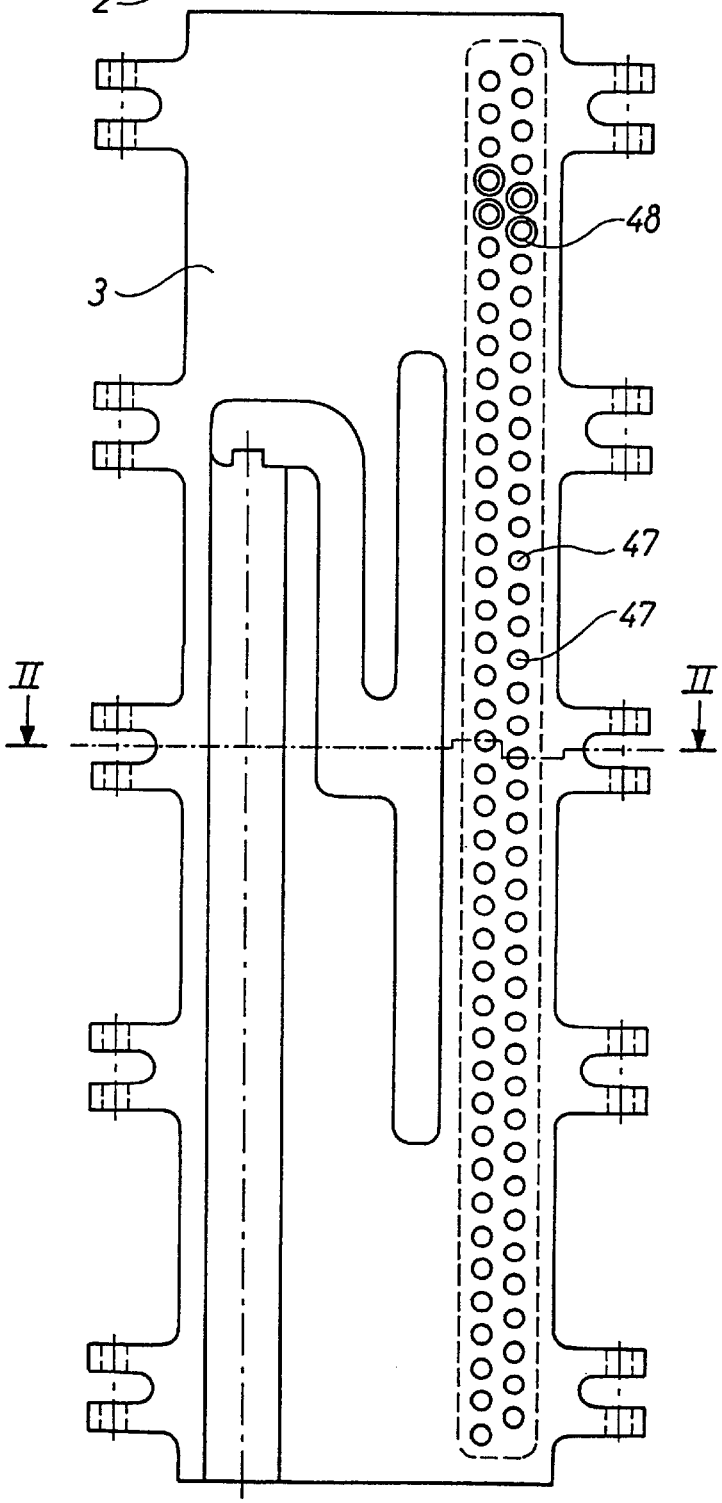
FIG. 3 is a view taken along the line III—III of FIG. 2 of one housing part.
Figure 4:
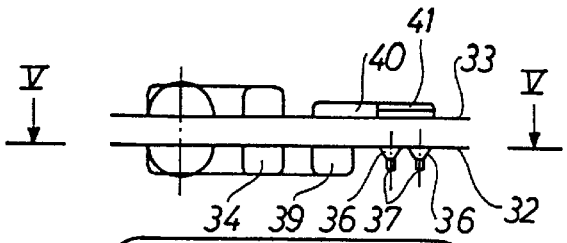
FIG. 4 is a sectional view taken along the line IV—IV of FIG. 5 through lining members to be arranged inside the spreader housing.
Figure 5:
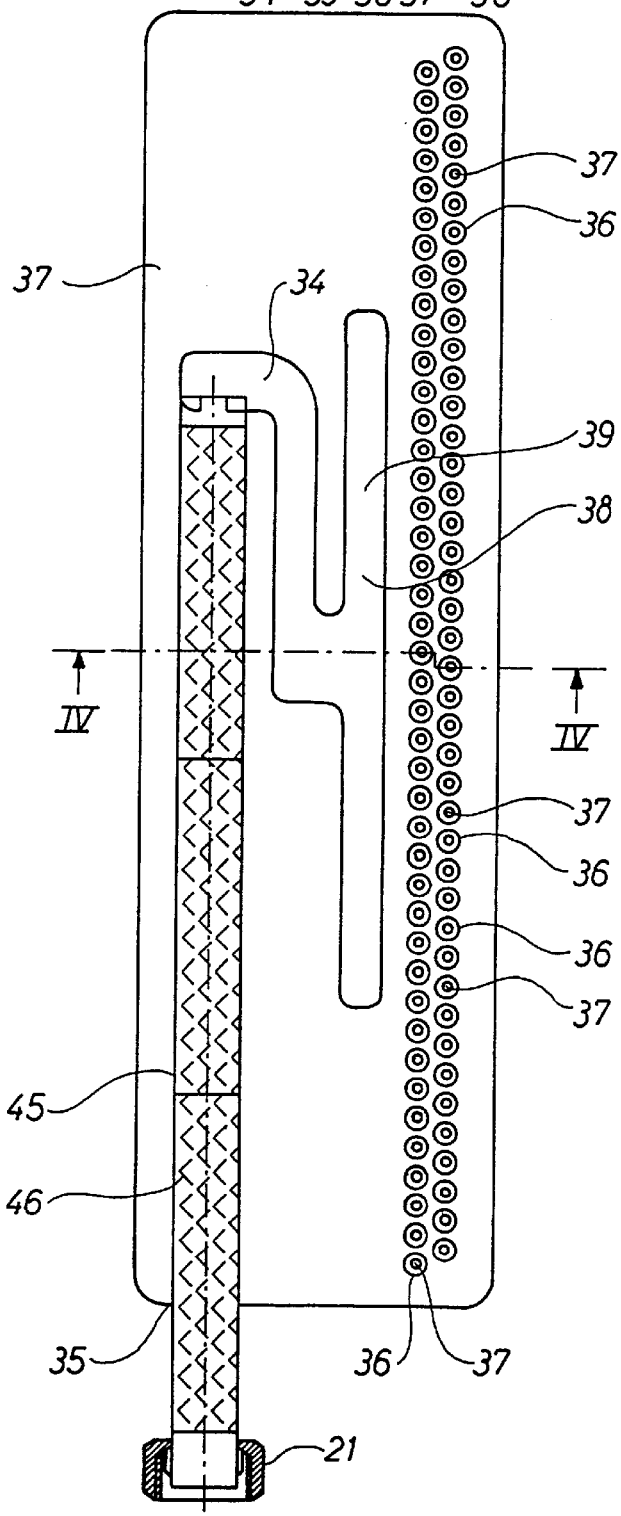
FIG. 5 is a view taken along the line V—V of FIG. 4 through one first lining member with a static mixer inserted therein.

As illustrated in FIGS. 2 and 3, the housing parts 2 and 3 of the spreader are provided with recesses or cavities on the opposing sides, said recesses being adapted to receive their respective lining members, cf. FIGS. 4 and 5. These lining members comprise a first lining member 32 to be received in the lower housing part 3 and a second lining member 33 to be received in the upper housing part 3. Each lining member 32 and 33 is made of plate or sheet-extruded plates of plastics. The plate or sheet-extruded plates are vacuum-moulded in such a manner that they define a feeding channel system at the reference numeral 34, cf. FIG. 5, when they abut one another. This feeding channel system extends from an opening provided at the reference numeral 35 and to a double row of nozzles 36 shaped in the first lining member 32. Each row of nozzles 36 comprises an outlet opening 37 resulting from a cutting off of plastic material from the vacuum-moulded plate.

The two lining members 32 and 33 are glued or welded to one another and then placed between the two housing parts 2 and 3. Subsequently, the housing parts 2 and 3 are tightened together in such a manner that the plane portions of the lining members adjacent the recesses sealingly abut one another, said recesses defining the feeding channel system 34 and the rows of nozzles 36. A comparison of FIGS. 4 and 5 demonstrates that the recesses in the two lining members are shaped substantially symmetrically everywhere from the inlet openings 35 to a distribution chamber 38 arranged parallel to the nozzles 36. The distribution chamber 38 is defined by a relatively deep recess 39 in the first lining member 32 and a relatively shallow recess 40 continuing into a further relatively shallow recess 41 in the second lining member 33. The relatively shallow recess extends like a trough opposite the row of nozzles 36, and the adhesive material flowing through the feeding channel system 34 and through the distribution chamber 38 is distributed through said trough 41 to the nozzles in such a manner that the adhesive is uniformly distributed to the individual nozzles.

The individual nozzles can be shaped with a varying outlet cross section and/or opposite a relatively shallow trough-shaped recess 41 of a varying depth in order to ensure a uniform volume flow rate out of the nozzles 36.

As the feeding channel system 34 continues into a distribution chamber adjacent the nozzles 36, and as most of said distribution chamber in use is positioned in the first lining member at a level below the inlet of each nozzle 36, and the trough-shaped nozzle feeding chamber 41 is of a relatively low depth in the second lining member, this structure of the feeding channel system has the effect that only a relatively small amount of adhesive is present at a level above said inlet to the nozzles with the result that an interruption of the propulsion of said adhesive does not cause a noticeable afterflow of adhesive out of the nozzles 36.

A tube 45 of plastics or metal is clamped between the lining members 32 and 33 in the first portion of the feeding channel system 34, said tube comprising a static mixer 36 of a conventionally known type, such as Kenics sold by Tah Europe Incorporation UK. The tube 45 is shaped such that at its end positioned outside the inlet opening 35 it can carry a union nut 21, cf. also FIG. 1, which is adapted to couple the spreader to the mixer head 20.

As mentioned above, the housing parts 2 and 3 are provided with recesses allowing the receiving of the lining members 32 and 33. As illustrated in FIGS. 2 and 3, these recesses comprise two rows of through openings 47 with chamfered edges 48. These openings 47 are adapted to receive their respective nozzles 36 in the first lining member 32 in such a manner that each nozzle is supported by the housing part 2 along its periphery.

Figure 6:
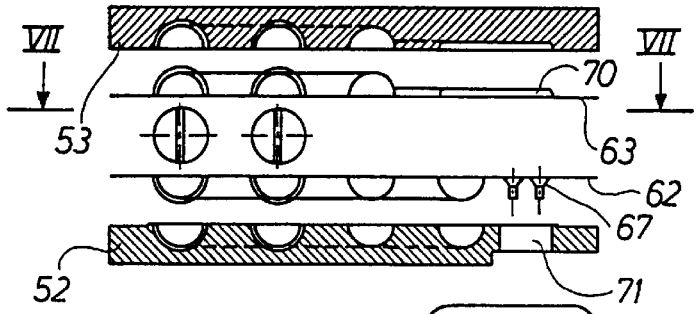
FIG. 6 is a sectional view taken along the line VI—VI of FIG. 7 through a second embodiment of a spreader according to the invention with associated lining members and static mixers, the individual parts being spaced apart for the sake of clarity.
Figure 7:
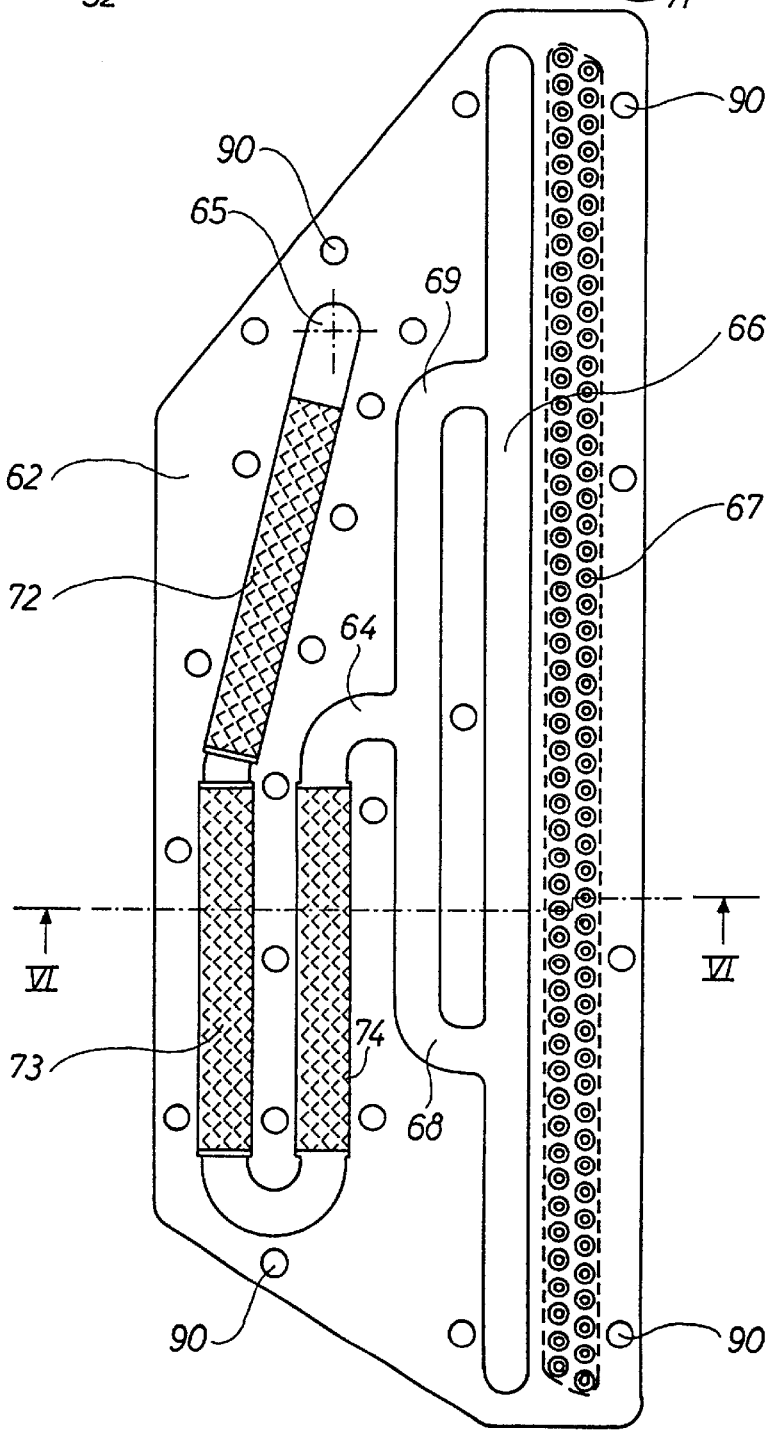
FIG. 7 is a view taken along the line VII—VII of FIG. 6 of one first lining member associated with the spreader of FIG. 6, said first lining member being shown with the associated static mixers.

The embodiment illustrated in FIGS. 6 and 7 of the spreader comprises a lower and an upper housing part 52 and 53, respectively, with an associated first and second lining member 62 and 63. The lining members 62 and 63 are shaped slightly different from the previously described lining members 32 and 33, and accordingly the recesses of the housing parts 52 and 53 are also shaped slightly different so as to fit said lining members. As illustrated at the reference numeral 64, the feeding channel system extends from an inlet opening 65 shaped by means of a branch not shown n greater detail. This branch extends through one of the housing parts 52 or 53 and comprises a device (not shown in greater detail either), which ensures a possibility of coupling said branch to a mixer head or the like feeding device. The feeding channel system extends in a manner defined by symmetrical recesses in the two lining members 62 and 63 from the inlet opening to a distribution chamber 66 which in turn extends parallel to a row of nozzles 67. The feeding channel system 64 forms a branching immediately before the distribution chamber 66 in such a manner that said distribution chamber 66 is supplied with adhesive through two channel sections 68 and 69. A relatively shallow trough-shaped recess 70 is formed in the second lining member 63 opposite the recess provided in the first lining member 62 and defining a portion of the distribution chamber 66. The relatively shallow trough-shaped recess 70 extends across the nozzles 67 with the result that it forms a connection between the distribution chamber 66 and the inlet opening of the nozzles 67 and accordingly form a chamber for the feeding of adhesive to the nozzles.

As illustrated in FIG. 6, the lower housing part 52 is provided with a longitudinal slot 71. All the nozzles 67 project from the interior of the housing of the spreader 1 through this slot 71 when the two housing parts 52, 53 are tightened together around the lining members 62 and 63. As illustrated in FIGS. 6 and 7, the feeding channel system 64 of the lining members 62 and 63 is shaped in such a manner that said lining members can receive static mixers 72, 73 and 74 which are received in their respective tubes. In the assembled state of the spreader 1 these static mixers are sealingly clamped between the lining members 62 and 63 in such a manner that adhesive cannot pass the static mixers round these tubes. Unlike the lining members, it is very easy to manufacture these tubes so as to exactly fit the static mixers in such a manner that the adhesive does not pass between the outer periphery of the static mixers and the inner side of said tubes. When the lining members 62, 63 are shaped and tightened between the housing parts 52 and 53 in such a manner that the static mixers can be received in the feeding channel system without the use of the separate tubes and such that the flow of adhesive does not pass round said static mixers, said separate tubes can, of course, be omitted.

Figure 8:
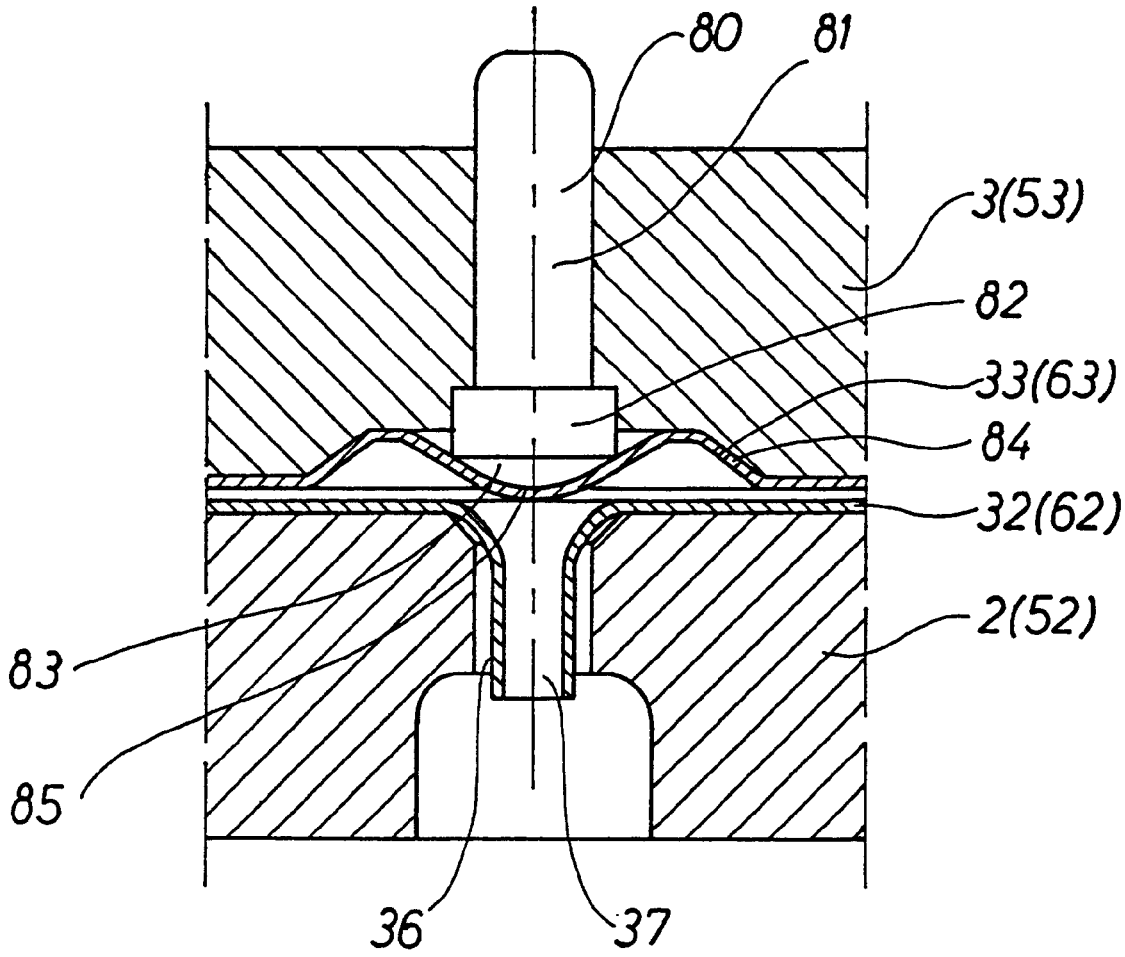
FIG. 8 is a diametrically sectional view through a closable nozzle of a portion of a third embodiment of a spreader according to the invention.

Displaceable adjustment means can be provided in connection with each nozzle, whereby it is possible to adjust the application width of the spreader 1, cf. FIG. 8. These adjustment means 80 are displaceably mounted in the upper housing part 3, such as by means of a thread connection. Generally speaking, such an adjustment means comprises a shank 81 with a head 82 abutting the second lining member 33, said head 82 comprising a convex surface 83 abutting said second lining member 33. Correspondingly, the second lining member is shaped with an annular convex surface 84 and a dome 85 extending centrally downwards towards each nozzle 36 so as to sealingly abut the inner side of said nozzle 36 at the inlet thereof.

An activation of the adjustment means 80 causes said means to be moved downwards towards the nozzle 36. Correspondingly, the upper second lining member 33 must be made of a resilient material implying that such an activation is possible.

The spreader according to the invention is as mentioned mainly used for applying a layer of adhesive onto continuously advanced plates, such as metal plates for the manufacture of sandwich elements. Before the use, the lining is positioned between the housing parts 2 and 3 followed by a tightening of said housing parts by means of the clamping means 9 to 18. Then, the adhesive system in question is carried in a conventionally known manner to the spreader, optionally in form of two components through their respective conduits 2, 3 and to a mixer head 20. In the mixer head 20, the components are mixed and enter the spreader in which the mixing is enhanced by means of the static mixers, such as 46 or 72 to 74, arranged therein. The adhesive is carried through the feeding channel system 34, 64 to and through the nozzles 36, 67 and over the relevant surface to be coated with a coating of adhesive. The described particular shaping of the feeding channel system adjacent the nozzles 36, 67 with the maximum volume at a level below the inlet opening of said nozzles has the effect that the adhesive applying process is interrupted for a short or a long period of time depending on the type of adhesive in question, and without involving a noticeable afterflow of adhesive through the nozzles and consequently without causing a hardening of said adhesive inside the nozzles. If adhesive nevertheless appears in the nozzles after use for a long time or after an interruption for a long time, it is not necessary to involve a difficult and time-consuming cleaning process because nothing but the lining of the spreader need to be replaced, said lining being relatively inexpensive to manufacture and consequently suited for disposable use. As mentioned, the application width can be adjusted by means of the adjustment means 80, such as by an activation thereof by means of a screwdriver. These adjustment means can, however, also be adapted to be adjusted by means of compressed air (not shown).

The lining is made of a suitable plastic or board material. It can for instance be manufactured by way of vacuum moulding of plate or sheet-extruded plates of a thermoplastic ester, such as PET.

The nozzles can be arranged in one or more rows, and according to an advantageous embodiment the nozzle opening is of a diameter of 1 to 3 mm, and especially 2 mm. The centre distance between the nozzles in the same row is advantageously 5 to 10 mm in order to ensure a uniform, carpet-like coating. As mentioned, the nozzle diameter can vary across the rows of the spreader in order to ensure the same volume flow rate.

The invention has been described with reference to a preferred embodiment. Many modifications can be carried out without thereby deviating from the scope of the invention. In connection with particularly large spreaders, it can for instance be a possibility to provide additional clamping means in addition to the clamping means 9 to 18 accommodated along the sides of the spreader, said additional clamping means being positioned between said sides. For such situations, the linings can be provided with suitable openings 90, cf. FIG. 7, for the passage of the additional clamping means. The lining has been described as made of two members glued or welded together. The lining can, however, also be integrally cast by means of suitable soluble cores. The two lining members can, if desired, also be joined in the spreader housing in another way beyond gluing or welding.

What is claimed is:

1. A spreader (1) for spreading a fluid, such as an adhesive, in a thin layer on a surface, said spreader comprising an oblong spreader housing (2, 3; 52, 53) and a plurality of outlet nozzles (36, 67) which are arranged at regular intervals along one side of the spreader housing (2, 3; 52, 53), and which are connected to a feeding channel system (34, 64) accommodated in the housing and in turn connected to an inlet opening (35, 65) for said fluid, characterised in that the nozzles (36, 67), their feeding channel system (34, 64) and the inlet opening (35, 65) are shaped in a separate lining (32, 33; 62, 63), detachably secured in the housing (2, 3; 52,53), whereby the housing (2, 3; 52, 53) comprises cavities receiving the lining (32, 33; 62, 63) and being adapted to fixedly clamp around said lining (32, 33; 62, 63) during the use of the spreader, at least one opening (47, 71) being provided in said housing (2, 3; 52, 53), where the nozzles (36, 65) project from the interior of the housing (2, 3; 52, 53) through said opening.

2. A spreader as claimed in claim 1, characterised in that the lining comprises two interconnected, substantially plate-shaped lining members (32, 33; 62, 63) with recesses provided therein to form the nozzles (36, 67), the feeding channel system (34, 64) of said nozzles as well as the inlet opening (35, 65).

3. A spreader as claimed in claim 1, characterised in that the housing comprises two hingedly interconnected housing parts (2, 3) provided with means (9 to 18) for tightening said housing parts (2, 3) around the lining.

4. A spreader as claimed in claim 2, characterised in that the lining members (32, 33; 62, 63) are plate or sheet-extruded, vacuum-moulded plates of plastics which are glued or welded to one another, whereby the outlet nozzles (36, 67) shaped in one lining member comprise outlet orifices or openings (37) resulting from a cutting off of portions of said lining member.

5. A spreader as claimed in claim 2, characterised in that the nozzles (36, 67) are shaped in a number of rows protruding from a plane of a first plate-shaped lining member (32, 62) in such a manner that each nozzle (36, 67) extends from a plane portion coinciding with the side facing the second lining member (33, 63), and that the feeding channel system (34, 64) forms a nozzle feeding chamber (41, 70) adjacent said nozzles (36, 67), where said nozzle feeding chamber is formed by a coherent recess in the second lining member (33, 63) opposite said nozzles (36, 67).

6. A spreader as claimed in claim 5, characterised in that the nozzle feeding chamber (41, 70) is formed by a small trough-shaped recess in the second lining member, where said small trough-shaped recess extends along the row or rows of nozzles (36, 67) and comprises longitudinal sides, of which one longitudinal side is positioned opposite the area along one side of the row or rows of nozzles (36, 67) and the other longitudinal side is positioned opposite the area along the opposite side of the row or rows of nozzles, but at a predetermined distance therefrom, said latter area being positioned upstream relative to the flow direction of the fluid inside the feeding channel system (34, 64), and where a comparatively larger recess is provided opposite the small trough-shaped recess at the upstream side and along the row or rows of nozzles (36, 67) in the first lining member (32, 62) comprising said nozzles (36, 67), whereby a distribution chamber (38, 66) is formed in this portion of the feeding channel system (34, 64), said distribution chamber communicating directly with the nozzle feeding chamber (41, 70).

7. A spreader as claimed in claim 6, characterised in that the portion of the feeding channel system (34, 64) adjacent the distribution chamber (38, 66) is formed substantially by one or more recesses in the first lining member (32, 62) housing the nozzles (36, 67).

8. A spreader as claimed in claim 1, characterised in that one or more static mixers (46; 72, 73, 74) is/are provided in the feeding channel system (34, 64).

9. A spreader as claimed in claim 8, characterised in that the static mixer(s) (46; 72, 73, 74) is/are arranged in their respective tubes.

10. A spreader as claimed in claim 8, characterised in that a static mixer (46) with the associated separate tube is arranged in connection with the inlet opening (35) and comprises projecting members with means for coupling the spreader (1) to a mixer head (20), which in turn comprises means for connecting conduits (22, 23) thereto, said conduits communicating with sources with their respective components of a two-component adhesive system.

11. A spreader as claimed in claim 4, characterised in that the second lining member (33, 63) is made of a resilient plastic material, and that the spreader (1) comprises means (80) for allowing a closing of each nozzle (36, 67) by pressing the second lining member (33, 63) towards the first lining member (32, 62) opposite each nozzle (36, 67).

12. A spreader as claimed in claim 2, characterised in that the lining members (33, 63) are integrally cast.

* * * * *